US009140096B2

(12) United States Patent
Tveiten et al.

(10) Patent No.: US 9,140,096 B2
(45) Date of Patent: Sep. 22, 2015

(54) VALVE SYSTEM

(75) Inventors: Magnar Tveiten, Sandnes (NO); Erling Kleppa, Jørpeland (NO); Øyvind Stokka, Sandnes (NO); Ole Sevheim, Stavanger (NO)

(73) Assignee: Petroleum Technology Company AS, Stavanger (NO)

( * ) Notice: Subject to any disclaimer, the term of this patent is extended or adjusted under 35 U.S.C. 154(b) by 446 days.

(21) Appl. No.: 13/577,855

(22) PCT Filed: Feb. 16, 2011

(86) PCT No.: PCT/NO2011/000055

§ 371 (c)(1),
(2), (4) Date: Aug. 23, 2012

(87) PCT Pub. No.: WO2011/102732

PCT Pub. Date: Aug. 25, 2011

(65) Prior Publication Data

US 2012/0305256 A1 Dec. 6, 2012

(30) Foreign Application Priority Data

Feb. 17, 2010 (NO) ..... 2010 0239

(51) Int. Cl.

| | |
|---|---|
| ***E21B 34/10*** | (2006.01) |
| ***E21B 43/12*** | (2006.01) |
| ***E21B 34/06*** | (2006.01) |

(52) U.S. Cl.

CPC ..... *E21B 34/106* (2013.01); *E21B 34/06* (2013.01); *E21B 34/107* (2013.01); *E21B 43/123* (2013.01)

(58) Field of Classification Search

CPC ..... E21B 34/107; E21B 43/12; E21B 34/106; E21B 43/123

USPC ..... 166/117.5, 313, 386, 322

See application file for complete search history.

(56) References Cited

U.S. PATENT DOCUMENTS

| | | | | |
|---|---|---|---|---|
| 3,665,955 | A * | 5/1972 | Conner, Sr. | 137/495 |
| 4,239,082 | A * | 12/1980 | Terral | 166/117.5 |

(Continued)

FOREIGN PATENT DOCUMENTS

| | | | |
|---|---|---|---|
| CN | 101493002 | A | 7/2009 |
| EP | 1 686 235 | A1 | 8/2006 |
| GB | 2 173 843 | A | 10/1986 |

*Primary Examiner* — Shane Bomar

*Assistant Examiner* — Christopher Sebesta

(74) *Attorney, Agent, or Firm* — Birch, Stewart, Kolasch & Birch, LLP

(57) ABSTRACT

The present invention relates to a valve system for use in a wellbore, the system comprising a side pocket mandrel and one or more well tools, where the side pocket mandrel (6) comprises an elongated body section (7) provided with connection means (8) at its ends, the elongated body section (7) being provided with a substantially fully open main bore (9) for alignment with the well tubing (3) and an offset side pocket bore (10). At least one through opening (12) is provided in the side pocket mandrel (6), leading into the side pocket bore (10), and at least one through opening (13) is provided in the internal wall (11), leading into the main bore (9), where the at least two openings (12, 13) are in fluid communication through the side pocket bore (10), in which side pocket bore (10) at least two valves (100, 101) are arranged in series to form a double fluid barrier between the main bore (9) and an outside of the pocket mandrel (6), the at least two valves (100, 101) being independently retrievable through at least one installation opening arranged in the internal wall (11) of the side pocket mandrel (6).

5 Claims, 2 Drawing Sheets

(56) References Cited

U.S. PATENT DOCUMENTS

| | | | | |
|---|---|---|---|---|
| 5,533,572 | A * | 7/1996 | Brady et al. | 166/250.05 |
| 5,782,261 | A * | 7/1998 | Becker et al. | 137/155 |
| 6,321,842 | B1 * | 11/2001 | Pringle et al. | 166/313 |
| 6,827,146 | B2 * | 12/2004 | Faustinelli | 166/319 |
| 2005/0098325 | A1 | 5/2005 | Myerley et al. | |
| 2005/0173125 | A1 | 8/2005 | Naquin et al. | |
| 2006/0124320 | A1 | 6/2006 | Smith et al. | |
| 2006/0137881 | A1 * | 6/2006 | Schmidt et al. | 166/372 |
| 2006/0162939 | A1 | 7/2006 | Vick, Jr. et al. | |
| 2007/0181312 | A1 * | 8/2007 | Kritzler et al. | 166/372 |
| 2009/0071658 | A1 * | 3/2009 | Reid et al. | 166/373 |
| 2011/0315401 | A1 | 12/2011 | White et al. | |

* cited by examiner

VALVE SYSTEM

The present invention regards a valve system used to perform different operations in oil and/or gas wells, especially to an artificial lifting system that is used to assist formation pressure in the well in order to extract more hydrocarbons out of the formation.

However, as known to a person skilled in the art, the present invention is not restricted to artificial lifting, as the valve system according to the present invention can also be utilized in other operations, for instance to inject chemicals into the well etc.

An oil and/or gas well is drilled into a hydrocarbon bearing earth formation, where the well is typically completed in order to allow hydrocarbon production from the formation. A formation like this may be comprised of several different layers, where each layer may contain one or more hydrocarbon components. Very often such a formation will also contain water, gas etc. Due to this, the conditions of production, i.e. the amount of oil, gas, water and pressure in the formation, will generally vary through the different layers of the formation, and will also be submitted to changes during the formation's time of production.

Hydrocarbon production often begins with sufficient pressure in the formation to force the hydrocarbons to the surface. As the production from the well continues, the reservoir usually loses pressure until production of hydrocarbons from the well is no longer provided by the formation pressure. Furthermore, in some wells, the formation pressure is insufficient to support the production from the well, even when the well is first completed.

Due to this, so-called artificial lift is used to supplement the formation pressure to lift the hydrocarbons from the formation to the surface of the well. The basic idea for all artificial lifting systems is to extract more hydrocarbons out of the reservoir.

For instance, an oil and/or gas well may be arranged with a sucker rod lifting system, where such a system normally comprises a drive mechanism arranged on a surface of the well, a sucker rod string and one or more downhole positive displacement pumps. Hydrocarbons can then be brought up to the surface of the wellbore, by pumping action of the downhole pump(s).

An alternative artificial lift system is a so-called gas lift system, where high pressure water or gas is injected either into the geological formation itself or into a production tubing of the well. The gas lift system may be a tubing retrievable gas lift system or a wire line retrievable gas lift system.

In the gas lift system, the high pressure gas from the surface can for instance be supplied to a space (annulus) between the production tubing and a casing of the well. The gas enters the production tubing from the annulus side, through a plurality of gas lift valves arranged along the length of the production tubing. The gas lift valves may then be positioned or arranged in the production tubing itself, or they may be arranged in so-called side pocket mandrels.

Side pocket mandrels are typically installed in a string of a production tubing in a well bore. The side pocket mandrel is provided with a full opening bore which is aligned with the bore of the production tubing and with a laterally offset side pocket bore which is designed to receive different well tools. Such well tools can be passed through the production tubing and are retrievably seated in the offset side pocket bore in order to perform or to monitor different operations in the well bore or production tubing. The well tools are retrievable and can be seated and recovered from the offset side pocket bore for instance by use of a kick over tool or similar tools. Well tools can typically include flow control devices, gas-lift devices, chemical injection devices etc., for use in conventional production operations. The side pocket mandrel may also accommodate other equipment, for instance sensors, plugs etc.

A side pocket mandrel will typically be comprised of a main mandrel body section provided with a substantially full opening main bore and a laterally offset side pocket bore, where the main mandrel body section is connected to tapered end sections by appropriate means, for instance by welding or the like. When the side pocket mandrel is connected to, for instance, a production tubing, the full opening main bore will be aligned with a bore of the production tubing, thereby allowing the production fluid to flow through the side pocket mandrel. The laterally offset side pocket bore is used to accommodate a well tool or other downhole equipment. The well tool or downhole equipment is then fastened to or seated on an inside of the laterally offset side pocket bore by means of one or more latching lugs or clamps.

The main mandrel body section is formed in such a way that the full opening main bore and the laterally offset side pocket bore are divided by an internal wall, such that well tools and/or other downhole equipment is/are separated from the production flow through the full opening bore. If the side pocket mandrel is used in a gas lift system, both the surface of the laterally offset side pocket and the internal wall of the side pocket mandrel are provided with one or more through slots or bores, such that pressurized gas introduced into the annulus can flow through the one or more slots or bores of the laterally offset side pocket and into the laterally offset side pocket bore, through a valve that is arranged inside the laterally offset side pocket bore and then into the production tubing through the slots or bores of the internal wall. The valve in the side pocket bore will then control the actual flow of the pressurized gas into the production tubing according to its specific design.

However, the pressurized gas that is released into the production tubing is normally not controlled otherwise than to break up a main injection stream of the pressurized gas into smaller streams and/or bubbles. This may result in that a significant part of the released gas stream will act against the production flow (i.e. is added with a direction downwards in the production tubing), thereby resulting in decreasing the production flow.

Furthermore, during the performing of the different operations in the well, it is often necessary to have access to the well tools and/or downhole equipment arranged in the side pocket mandrel. For instance, a gas lift valve will typically after a period of use require maintenance, repair, replacement and/or changing of the pressure setting of the gas lift valve etc. In order to carry out the necessary operation, the gas lift valve must be retrieved from the laterally offset side pocket bore. This will result in that the side pocket mandrel will be "open", whereby a production fluid from the production tubing will be allowed to flow from the production tubing and into the annulus of the well. In order to prevent this, the well has to be shut down or closed in other ways, where this results in an undesired production standstill and increased production costs.

U.S. Pat. No. 4,239,082 "Multiple flow valves and sidepocket mandrel" discloses a side pocket mandrel on a production tubing, the side pocket mandrel having two parallel inlets for gas from the surrounding annulus space to two parallel valves arranged on a common valve stem, with the two parallel valves provided each with a separate outlet to the main bore aligned with the production tubing. The valves may be gas lift valves.

Accordingly, it is an object of the present invention to provide a valve system that minimizes and/or alleviates the above problems.

It is also an object of the present invention to provide a valve system that can control the flow of injection gas in a more effective way, thereby increasing the production flow in a production tubing.

Another object of the present invention is to provide a valve system that allows replacement of well tools and/or downhole equipment, without shutting down the well.

Still one object of the present invention is to provide a valve system where the well tools and/or downhole equipment can be replaced independently of each other.

These objectives are achieved with a side pocket mandrel according to the present invention as defined in the enclosed independent claims, where embodiments of the invention are given in independent claims.

The present invention regards a device used to perform different operations in oil and/or gas wells, for instance an artificial lift operation. More particularly, the present invention relates to a valve system for use in a wellbore, where the valve system comprises a side pocket mandrel having an elongated body section, the elongated main body being provided with a substantially fully open main bore for alignment with a well tubing and a laterally offset side pocket provided with a bore, the substantially fully open main bore and the laterally offset side pocket bore being divided by an internal wall. At least one through opening is provided in the side pocket mandrel, leading into the laterally offset side pocket bore, and at least one through opening is provided in the internal wall, leading into the substantially fully open main bore. The at least two through openings are in fluid communication through the laterally offset side pocket bore, where this arrangement will allow a fluid from an annulus to be injected into the well tubing, as the fluid will enter the laterally side pocket mandrel bore through the at least one opening provided in the side pocket mandrel, flow through the laterally offset side pocket bore, and thereafter entering the substantially fully open main bore of the elongated body section through the opening in the internal wall. In the laterally offset side pocket bore at least two valves are arranged in series in order to form a double barrier inside the laterally offset side pocket bore, where the at least two valves are independently of each other retrievable, through at least one installation opening arranged in the internal wall of the side pocket mandrel.

As a person skilled in the art will know, the valve may be different flow control devices, gas lift devices, chemical injection devices etc.

The valve system according to the present invention may also accommodate other downhole tools, equipment and/or devices.

In one preferred embodiment of the present invention the at least two valves which are arranged in the laterally offset side pocket bore are gas lift valves, where this arrangement will provide a connection between an outside and an inside of the side pocket mandrel, such that a fluid, for instance pressurized gas, may be injected into the production tubing through an annular space between a casing and a production tubing. Each of the at least two retrievable valves will act as a separate and independent fluid barrier in such an arrangement, whereby a double fluid barrier is formed inside the side pocket mandrel.

According to another embodiment of the present invention, the valve system may also be provided with an additional pressure or fluid barrier, where this pressure or fluid barrier can be arranged in connection with the at least one opening (slot or inlet) provided in the laterally offset side pocket of the side pocket mandrel.

As indicated above, a "fluid barrier" can be any element that has the capacity to prevent a fluid medium from flowing through the element. Such elements can for instance be a gas lift valve, one-way valve, orifice or choke valve, bellows valve, nitrogen charged dome valve, pilot valve, differential valve etc.

The valves that are accommodated in the laterally offset side pocket can, for instance, be gas lift valves or chemical medium injection valves, one-way valves etc., where these are used to enhance the production in the oil and/or gas well.

The side pocket mandrel is also provided with connection means at both of its ends, in order to connect the side pocket mandrel to the well tubing, for instance the production tubing. The connection means that are provided at each end of the ends may in a preferred embodiment of the present invention be threads. However, it should be understood that clamps, bolts etc. could also be used in order to connect the side pocket mandrel to adjacent tubular members. The side pocket mandrel may also be welded to the production tubing.

The at least two valves that are accommodated in the laterally offset side pocket bore are preferably both arranged to be retrievable, but is should be understood that one of the valves may also be permanently installed in the laterally offset side pocket bore.

Furthermore, the at least two valves are in fluid communication with each other, the valves either being connected directly to each other or being indirectly connected to each other by means of the laterally offset side pocket bore.

Preferably the valve that is arranged closest to the at least one through opening (inlet) in the laterally offset side pocket is considered to form a primary fluid barrier in the side pocket mandrel, while the valve that is arranged closest to the at least one opening (outlet) to the substantially fully open main bore in the internal wall will form a secondary fluid barrier. Furthermore, in a preferred embodiment of the present invention, the valve that forms the primary fluid barrier is provided with a constant and none-adjustable orifice, while the valve that forms the secondary fluid barrier is provided with an adjustable orifice.

The valves that are arranged in the laterally offset side pocket may be arranged to open or close at the same pressure, but they can also be arranged to operate at different pressures. The latter arrangement will, for instance, result in that the valve system according to the present invention can be adapted to each wellbore' specific parameters, whereby undesirable incidents can be prevented.

The side pocket mandrel of the valve system according to the present invention may preferably comprise other downhole tools, measuring equipment and/or devices, where this will depend on which operation(s) is/are to be performed, as well as the specific characteristics of the oil and/or gas well.

The internal wall between the laterally offset side pocket bore and the substantially fully open main bore of the elongated body section may be provided with several through openings (injection orifices, outlets), where the number of openings will depend on the characteristics of the well, which medium is to be injected into the well tubing etc. Furthermore, the openings may also be arranged to be bevelled or angled relative to a longitudinal axis of the side pocket mandrel, or formed to give the injection medium a rotation before entering the production tubing, in order to optimize the stimulation of the production fluids. Furthermore, at least one replaceable sleeve may also be arranged on the outside or inside of the main bore or the offset side pocket of the elongated body, where the at least one sleeve through the adjustment can control the "opening" of the openings. The at least one sleeve may be arranged to rotate around the bore or to slide in a longitudinal direction of the bore.

The opening or closing of the openings may be hydraulically or electrically controlled or controlled by pressure pulses/surges in the injection fluid. A special tool may also be used to control the adjustment of the outlets mechanically. The special tool is then run into the well.

In order to be able to control the injection of gas and/or chemicals in a production tubing, the side pocket mandrel and the sleeve(s) may be arranged to be operated electrically, hydraulically or by remote control. However, in a preferred embodiment of the invention the side pocket mandrel and sleeve(s) are both operated hydraulically. Of course, one could also arrange the side pocket mandrel to be operated hydraulically, while the rotatable sleeve(s) for instance may be operated electrically. In a similar way the adjustable orifice of the second retrievable "fluid barrier" may also be arranged to be regulated.

In one preferred embodiment of the present invention, the at least one rotatable or slidable sleeve is provided with at least one through recess on its surface. This will give the operator the possibility to control the injection of gas and/or chemicals from the side pocket mandrel and into the production tubing, as the sleeve can be rotated around or slide along a longitudinal axis of the production tubing, thereby adjusting the opening of the opening(s) (injection orifices, outlets) with the recess in the sleeve. The recess or recesses in the sleeve may also be shaped to optimize the injection stream from the valve and into the production tubing. As in the case of the injection orifices, the recesses in the sleeve may be shaped bevelled or angled.

In one preferred embodiment of the present invention the side pocket mandrel of the valve system is provided with measurement equipment, as the production parameters may vary during the stimulation of the well production. Typical parameters that will vary during this operation may be pressure, temperature, gas/oil-ratio, water cut etc. By carrying out these measurements, one can influence the injection of medium, thereby obtaining an optimal condition for injection of medium into the production tubing. Further measuring equipment may measure leakage, composition of hydrocarbons etc.

As the side pocket mandrel of the valve system according to the present invention is intended to accommodate a number of valves and/or other downhole equipment, it is suitable to manufacture the side pocket mandrel from several sections. Each section can then be shaped to accommodate the specific "tool", which will result in that the side pocket mandrel can be adapted individually to each well. The sections may be provided with threads, quick connections etc. in order to be connected with each other.

During the installation of the different valves and/or downhole equipment in the side pocket mandrel, there is often a degree of uncertainty as to whether the valve and/or equipment are safely put into its end stoppers. The side pocket mandrel according to the present invention may therefore be provided with a positioning device, thereby ensuring that the operator will receive a signal when the valves and/or equipment are properly installed.

The novel features of the present invention, as well as the invention itself, will be best understood from the attached drawings, considered with the following description, to which similar reference numerate refer to similar parts, and in which.

Figure 1:
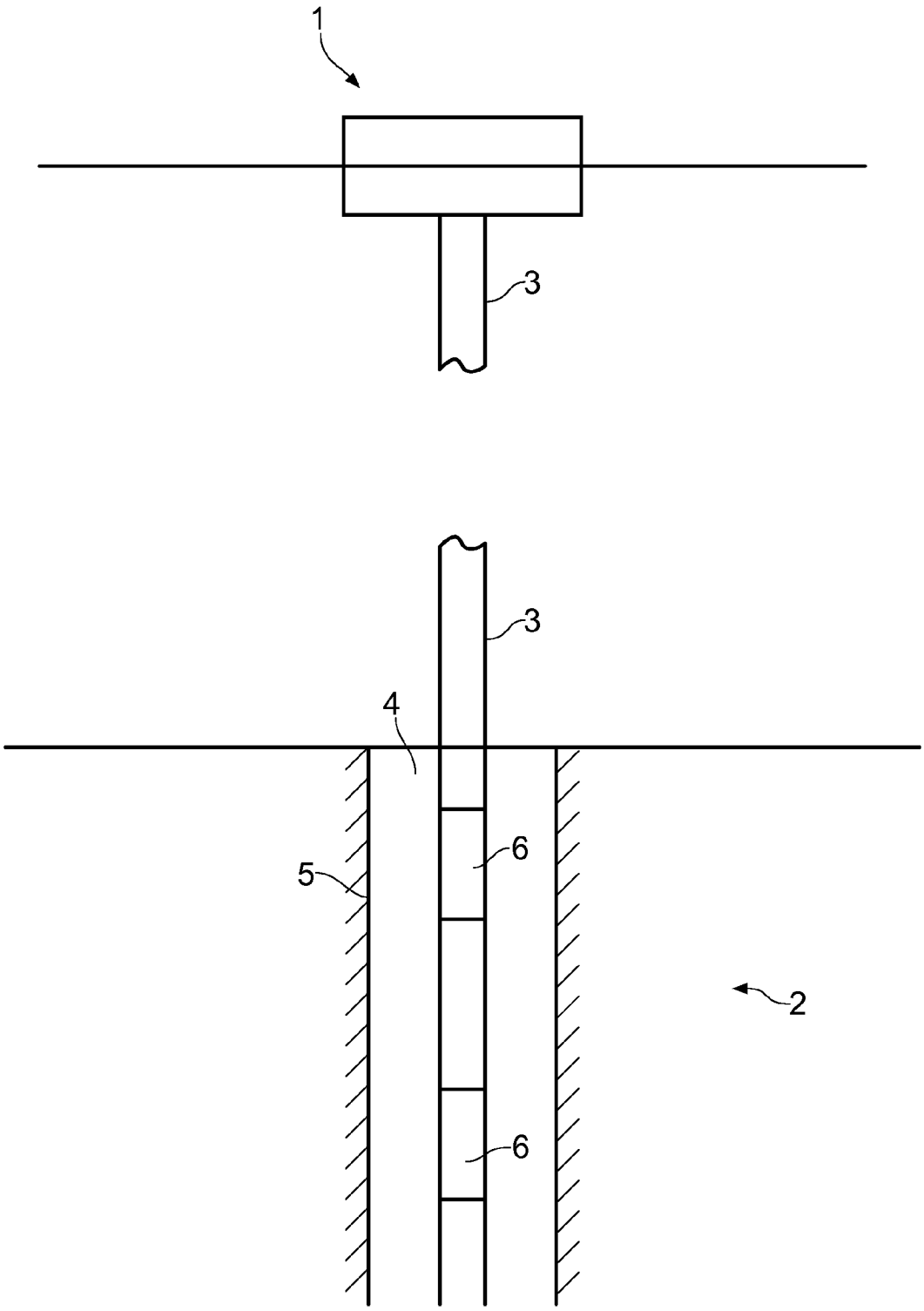
FIG. 1 is a schematic view of an oil and/or gas well.

While the invention is subject to various modifications and alternative forms, specific embodiments have been shown by way of examples in the drawings and will be described in detail herein. The drawings are not necessarily in scale and the proportions of certain parts have been exaggerated to better illustrate particular details of the present invention.

Referring now to FIG. 1, an embodiment of the present invention is shown, where a floating structure 1 or a sea- or land-based structure (not shown) is connected to an oil and/or gas well 2 by a production tubing 3. The floating structure 1 and the sea- or land-based structure can be production and/or storing facilities. In this embodiment the valve system according to the present invention is used as an artificial lift system.

In order to enhance the production of the oil and/or gas well 2, a pressurized fluid medium is injected into the annular space (annulus) 4 between a casing 5 of the oil and/or gas well 2 and the production tubing 3. Along the production tubing 3 is/are arranged a plurality of side pocket mandrels 6, where the side pocket mandrels 6 are connected to tubular elements of the production tubing 3 in appropriate ways.

Figure 2:
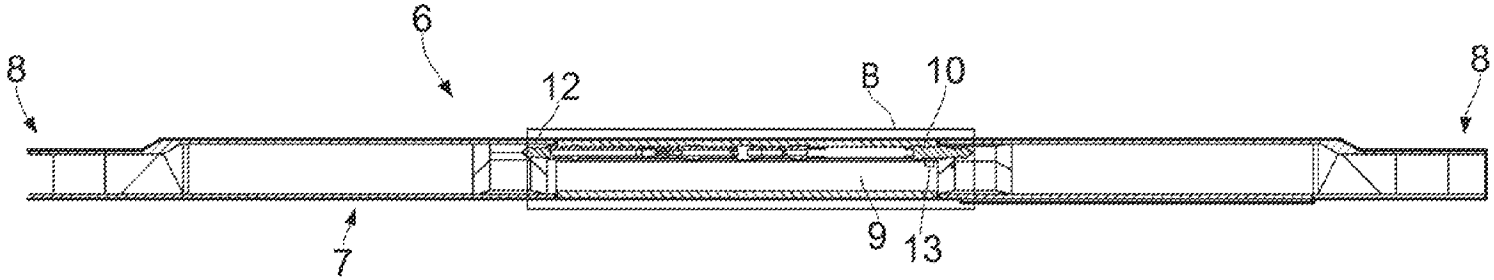
FIG. 2 shows a valve system according to a preferred embodiment of the present invention.

FIG. 2 shows the valve system according to the present invention, where the valve system comprises a side pocket mandrel 6, in which at least two valves 100, 101 in form of gas lift valves (see also FIG. 3) are arranged. Each and one of the valves 100, 101 forms a "fluid barrier" in the side pocket mandrel 6. The valves 100, 101 are designed to open at a given differential pressure between two fluids or two positions in the well, for instance across the valve 100, 101 or in two different positions arranged relatively above each other in the well, where this differential pressure may vary between the different valves 100, 101. In addition, if the pressurized fluid in the annular space 4 reaches a certain limit value, then the valves 100, 101 will open and the pressurized fluid will be allowed to flow through the valves 100, 101 and into the production tubing 3.

The fluid medium can be gas, liquid, processed well fluid or even a part of the well fluid from the reservoir and can be taken at a position in the vicinity of the side pocket mandrel 6 (that is from the well) or added from the floating installation 1 (or other sea or land based structures, not-shown) away from the side pocket mandrel 6.

How many side pocket mandrels 6 should be placed along the production tubing 3 and which features they should possess will depend on the needs of the field or each specific well.

Figure 3:
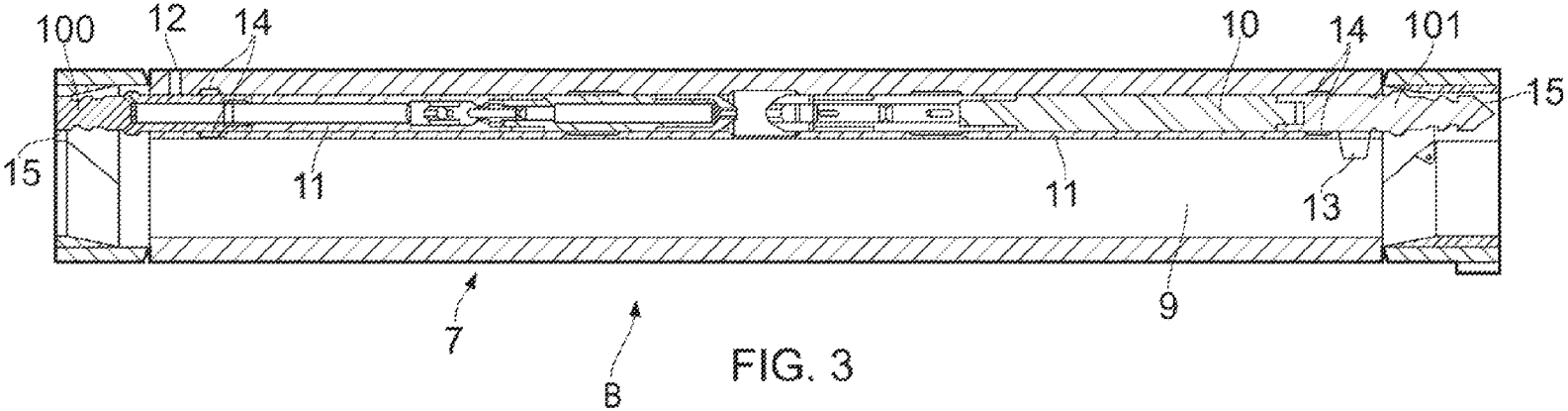
FIG. 3 shows an enlarged cross section view of a mandrel of the valve system according to FIG. 2.

FIG. 3 shows an enlarged cross section view (indicated with B in FIG. 2) of the side pocket mandrel 6 of the valve system, where it can be seen that the side pocket mandrel 6 comprises an elongated tubular body section 7 that is provided with connecting means 8 (just indicated) at both of its ends. The connecting means 8 is a threaded portion on the inside (or outside) of the tubular body section 7, such that the tubular body section 7 can be connected to a well tubing, such as a production tubing 3. The tubular body section 7 is provided with a through substantially fully open main bore 9 and a laterally offset side pocket bore 10. When the side pocket mandrel 6 is connected to the production tubing 3 the main bore 9 will be aligned with a bore of the production tubing 3.

The tubular body section 7 will then have two flowing paths, as the substantially fully open main bore 9 is separated from a laterally offset side pocket bore 10 by an internal wall 11 (see also FIG. 3).

The laterally offset side pocket bore 10 is shaped to accommodate at least two "fluid barrier" elements, for instance in form of gas lift valves 100, 101, and/or other equipment or tools (not shown). The expression "fluid barrier" should be understood as an element that will prevent a fluid medium from flowing over the element in at least one direction. This will provide a double barrier inside the side pocket mandrel 6. If for instance one of the valves 100, 101 in the laterally offset side pocket bore 10 due to different reasons has to be maintained, replaced or adjusted, a kick over tool may be run down the production tubing 3 in order to retrieve the valve 100,101. At least one installation opening (not shown) is then arranged in the internal wall 11 of the side pocket mandrel 6. When the valve 100, 101 is removed by the kick over tool, the other remaining valve 100,101 in the side pocket mandrel 6 will prevent production fluid within the production tubing 3 from flowing out of the production tubing 3, through the side pocket mandrel 6 and into the annular space 4 between the production tubing 3 and the casing 5 of the well.

The laterally offset side pocket bore 10 is on its inside provided with at least two landing receptacles 15 for the valves 100, 101 and/or other equipment, such that the valves 100, 101 and/or equipment (not shown) can be fixed in the landing receptacles 15. The landing receptacles 15 are provided with at least one set of packing elements 14. When the valves 100, 101 and/or other equipment are introduced into the landing receptacles 15, the valves 100, 101 and/or other equipment will be maintained under pressure, due to the compression created by the packing elements 14. This will also provide the necessary seals between the valves 100, 101 and/or other equipment and the landing receptacles 15.

The side pocket mandrel 6 of the valve system is designed in a manner such that the valves 100, 101 and/or other equipment may be replaced when necessary without having to pull out the tubing. This replacement may be accomplished by means of an operation in which special tools (not shown) are lowered through the interior of the production tubing 3. The special tools are attached to a fine steel cable or to a wire line. The special tools may for instance be kick over tools or the like.

Furthermore, the side pocket mandrel 6 is provided with at least one through opening (inlet) 12 (just indicated), where the at least one through opening 12 is provided in the laterally offset-side pocket bore 10. This will provider communication between an outer and inner side of the laterally offset side pocket bore 10. Similarly, at least one opening (outlet) 13 (just indicated) to the substantially fully open main bore 9 in the laterally offset side pocket bore 10 (will be the inlet to the substantially fully open main bore 9) is provided in the internal wall 11 that is dividing the substantially fully open main bore 9 and the laterally offset side pocket bore 10. This will provide a communication between the outside and the inside of the side pocket mandrel 6.

In the figure the at least one opening 12 is arranged in a vicinity of an inlet (not shown) of the valve 100 in the laterally offset side pocket bore 10, such that when a fluid from the annulus enters the laterally offset side pocket bore 10, the fluid medium will be guided into an inlet of the first valve 100. This first valve 100 will then be considered to be the primary fluid barrier in the side pocket mandrel 6. When the fluid reaches a limit valve (set by the pressure settings of the valve), the valve 100 will open and allow the fluid medium to flow through the valve 100. The fluid medium will then reach the second valve 101 arranged in the laterally offset side pocket bore 10, where this valve 101 is considered to be the secondary fluid barrier in the side pocket mandrel 6. This second valve 101 may have the same pressure settings as the first valve 100, but preferably the second valve 101 will have a lower pressure limit value. The valve 101 will therefore open and allow the fluid to flow through the valve 101 and into the substantially fully open main bore 9 of the tubular body section 7, through the at least one opening (outlet) 13 of the laterally offset side pocket bore 10.

Furthermore, at least one replaceable sleeve (not shown) is arranged on the outside or inside of the main bore 9 or the offset side pocket bore 10, where the at least one sleeve through the adjustment can control the "opening" of the openings 12, 13. The at least one sleeve may be arranged to rotate around the bore 9, 10 or to slide in a longitudinal direction of the bore 9, 10.

The invention claimed is:

1. A valve system for use in a wellbore, comprising a side pocket mandrel, wherein:

the side pocket mandrel comprises an elongated body section, the elongated body section being provided with a substantially fully open main bore for alignment with a well tubing and a laterally offset side pocket provided with a bore, the substantially fully open main bore and the laterally offset side pocket bore being separated by an internal wall, at least one through opening is provided in the side pocket mandrel, leading into the side pocket bore, and at least one through opening is provided in the internal wall leading into the main bore, where the at least two openings are in fluid communication through the side pocket bore, and in said side pocket bore at least two valves are arranged in series to form a double fluid barrier between the main bore and an outside of the pocket mandrel, the at least two valves being independently retrievable through at least one installation opening arranged in the internal wall of the side pocket mandrel, wherein the at least two valves are configured to open or close in response to pressure.

2. The valve system according to claim 1, wherein the valves are flow control devices, gas lift devices, or chemical injection devices.

3. The valve system according to claim 1, wherein the at least two valves arranged inside the side pocket bore, the valves either being connected directly to each other or being indirectly in fluid communication by said side pocket bore.

4. The valve system according to claim 1, wherein the valves are arranged to open or close at the same pressure.

5. The valve system according to claim 1, wherein the valves are arranged to open or close at different pressures.

* * * * *